US007604433B2

(12) United States Patent
Face, III et al.

(10) Patent No.: US 7,604,433 B2
(45) Date of Patent: Oct. 20, 2009

(54) CONCRETE SCREED WITH VERTICALLY ADJUSTABLE GATE

(75) Inventors: S. Allen Face, III, Wilmington, NC (US); Albert D. Frankeny, II, Mt. Pleasant, SC (US)

(73) Assignee: Laser Strike, LLC, Wilmington, NC (US)

( * ) Notice: Subject to any disclaimer, the term of this patent is extended or adjusted under 35 U.S.C. 154(b) by 0 days.

(21) Appl. No.: 12/069,743

(22) Filed: Feb. 12, 2008

(65) Prior Publication Data

US 2009/0202299 A1 Aug. 13, 2009

(51) Int. Cl.
*E01C 19/22* (2006.01)

(52) U.S. Cl. ..... 404/84.5; 404/84.05; 404/84.1; 404/84.2; 404/118

(58) Field of Classification Search ..... None
See application file for complete search history.

(56) References Cited

U.S. PATENT DOCUMENTS

| | | | | | |
|---|---|---|---|---|---|
| 3,415,173 | A * | 12/1968 | Paul | 404/118 |
| 3,555,983 | A * | 1/1971 | Swisher et al. | 404/114 |
| 3,782,844 | A * | 1/1974 | Burgin | 404/84.2 |
| 3,838,933 | A * | 10/1974 | Lehman et al. | 404/114 |
| 3,841,777 | A * | 10/1974 | Domenighetti | 404/84.1 |
| 4,861,188 | A * | 8/1989 | Rouillard | 404/75 |
| 5,348,418 | A * | 9/1994 | Campbell | 404/103 |
| 5,362,176 | A * | 11/1994 | Sovik | 404/72 |
| 5,549,413 | A * | 8/1996 | Bolden | 404/93 |
| 6,056,474 | A * | 5/2000 | Nolan | 404/118 |
| 6,089,787 | A * | 7/2000 | Allen et al. | 404/118 |
| 6,174,105 | B1 * | 1/2001 | Holmes et al. | 404/104 |
| 6,923,595 | B1 * | 8/2005 | Chek | 404/118 |
| 6,953,304 | B2 * | 10/2005 | Quenzi et al. | 404/114 |
| 6,976,805 | B2 * | 12/2005 | Quenzi et al. | 404/114 |
| 7,121,762 | B2 * | 10/2006 | Quenzi et al. | 404/84.1 |
| 7,195,423 | B2 * | 3/2007 | Halonen et al. | 404/84.5 |
| 2009/0175681 | A1 * | 7/2009 | Pietila et al. | 404/75 |

* cited by examiner

*Primary Examiner*—Raymond W Addie
(74) *Attorney, Agent, or Firm*—Peter J. Van Bergen

(57) ABSTRACT

A floating screed device has a first section for cutting through plastic concrete and a second section for floating on the plastic concrete. The first and second sections are coupled together by a mechanism that moves the first section relative to the second section in a direction perpendicular to the planar bottom of the second section as the floating screed device is moved through a volume of unfinished plastic concrete.

6 Claims, 3 Drawing Sheets

CONCRETE SCREED WITH VERTICALLY ADJUSTABLE GATE

CROSS-REFERENCE TO RELATED PATENT APPLICATIONS

This patent application is co-pending with two related patent applications entitled "CONCRETE SCREED WITH MOVABLE LEADING EDGE", Ser. No. 11/126,632, and "CONCRETE SCREED WITH MOVABLE LEADING EDGE", Ser. No. 11/294,270, filed by the same inventors and owned by the same assignee as this patent application.

FIELD OF THE INVENTION

The invention relates generally to screeding devices, and more particularly to a floating screed device that has a vertically adjustable gate forming the device's leading edge.

BACKGROUND OF THE INVENTION

Floating screeds are used to strike off and finish concrete floors or other horizontal surfaces. In general, a floating screed has a heavy planar float with an elongated edge defining a blade. The blade forms the leading edge of the screed that cuts through a volume of plastic concrete as the screed is pulled therethrough. Excess concrete that builds up on the blade side of the screed is raked away by workers standing in the unfinished concrete. As the float moves over an area of the concrete cut by the blade, the float serves to smooth the concrete thereby leaving a finished region of concrete that should be smooth, level, and at a specified elevation.

To achieve the desired elevation, the screed operator is constantly pushing down or pulling up on the screed to adjust the position of the screed's blade edge. However, prior art screeds link the screed's blade edge and float such that the pitch of the float tends to track the pitch of the blade edge which can affect the pitch and target elevation of the finished region of concrete.

SUMMARY OF THE INVENTION

Accordingly, it is an object of the present invention to provide a floating screed device that can be controlled to produce smooth and level concrete surfaces at a desired elevation.

Other objects and advantages of the present invention will become more obvious hereinafter in the specification and drawings.

In accordance with the present invention, a floating screed device has a first section defining a leading edge for cutting through plastic concrete. A second section has a planar bottom for floating on the plastic concrete. The first section and second section are coupled to one another by a mechanism that can move the first section relative to the second section in a direction perpendicular to the planar bottom of the second section as the floating screed device is moved through a volume of the plastic concrete that is unfinished. As this occurs, the leading edge defines an initial contact edge between the floating screed device and the volume of the plastic concrete that is unfinished.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
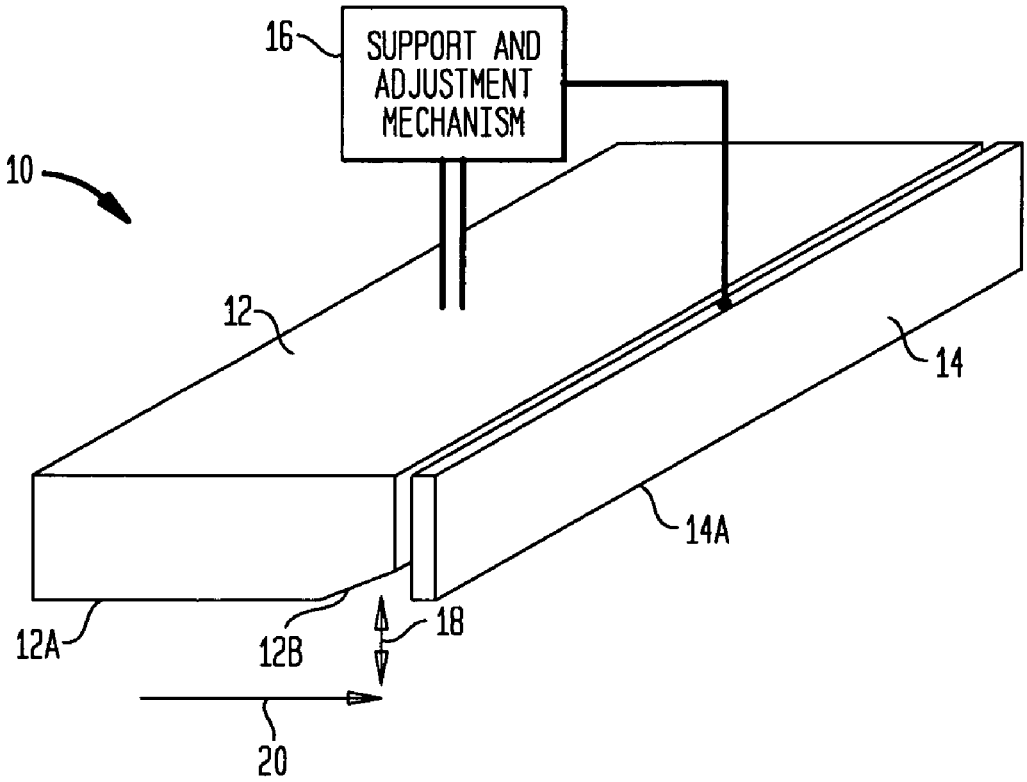
FIG. 1 is a perspective view of a floating screed device according to an embodiment of the present invention.

Referring now to the drawings, and more particularly to FIG. 1, an embodiment of a floating screed device in accordance with the present invention is shown and is referenced generally by numeral 10. Floating screed device 10 is an elongate device as would be well understood in the art. Floating screed device 10 includes (i) an elongate float 12, (ii) a bar 14 spaced apart from float 12 and substantially commensurate in length with float 12, and (iii) a support and adjustment ("S/A") mechanism 16 coupled to each of float 12 and bar 14 for maintaining the spaced-apart relationship therebetween and for adjusting the position of bar 14 relative to float 12.

Float 12 defines a planar bottom 12A that "floats" on a plastic concrete surface (not shown) to be finished. Bar 14 is an elongate piece of stiff material movable (by means of S/A mechanism 16) in either direction that is perpendicular to bottom 12A as indicated by two-headed arrow 18. Since bottom 12A will typically be oriented to be substantially in line with (or substantially parallel to) a locally horizontal datum, movement of bar 14 perpendicular to bottom 12A will generally result in a substantially up or down vertical movement of bar 14 with respect to the locally horizontal datum. In other words, bar 14 functions as a vertical gate. In this configuration, bar 14 defines the leading edge of floating screed device 10 so that the bar's bottom edge 14A defines the finish height of concrete being finished as screed device 10 is moved in the direction of arrow 20.

It is to be understood that the particular design and/or shape of float 12, bar 14 and S/A mechanism 16 are not limitations of the present invention. For example, float 12 can be substantially rectangular in cross-section (as shown) having a beveled, lower leading edge 12B to facilitate movement over concrete. However, float 12 could be defined by other geometric shapes without departing from the scope of the present invention. Float 12 could be hollow, solid, or filled with a granular material, a solid material, or a fluid.

With respect to bar 14, its shape and construction details can be any shape that would allow bar 14 to cut through plastic concrete as floating screed device 10 was moved along direction 20. For example, bar 14 could be a rigid piece of solid or hollow material (e.g., metal, wood, composite, etc.) having a rectangular cross-section as shown.

With respect to S/A mechanism 16, its design and construction can be any that supports bar 14 in its spaced-apart relationship with float 12 while also facilitating the above-described perpendicular movement of bar 14 relative to float bottom 12A. S/A mechanism 16 would typically include a powered actuator (e.g., hydraulic, electric solenoid, etc.) that could be controlled/operated manually or could be equipped to cooperate with a height/level defining system (e.g., a laser level system) for automatic movement of bar 14 as screed device 10 moves in the direction of arrow 20.

Figure 2A:
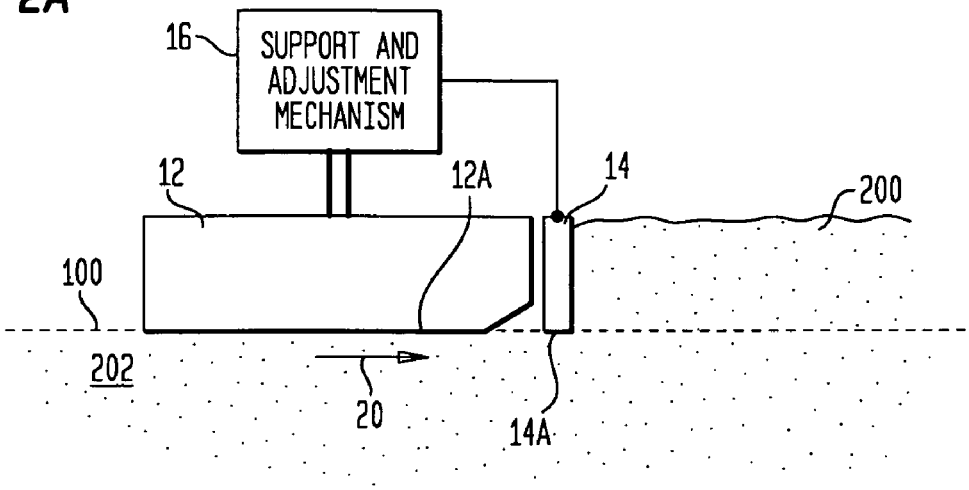
FIG. 2A is a side schematic view of the floating screed device of FIG. 1 operating at a target elevation.

The present invention improves the screeding operation as the floating screed device is more easily manipulated to a finished-concrete target elevation. To illustrate operation of the present invention, reference will now be made to FIGS. 2A-2C where a target elevation for a finished concrete surface is illustrated by dashed line 100. In general, target elevation 100 refers to a datum (e.g., typically a locally horizontal datum) that defines what should be the finished concrete surface. For purpose of illustration, operations will be described as floating screed device 10 moves in direction 20 through an unfinished volume of plastic concrete 200. Relative to direction 20, the unfinished volume of plastic concrete 200 is forward of device 10 while finished concrete 202 trails device 10. The unfinished volume of plastic concrete 200 is typically at a height above target elevation 100 so that bar 14 must cut therethrough.

In use, whatever the orientation of bottom 12A of float 12 (i.e., horizontal, tilted, at target elevation 100, or above/below target elevation 100), bottom edge 14A of bar 14 is kept at target elevation 100. For example, floating screed device 10 is "on grade" (i.e., bottom 12A of float 12 is at target elevation 100) in FIG. 2A and bottom edge 14A of bar 14 is kept at target elevation 100 as shown.

Figure 2B:
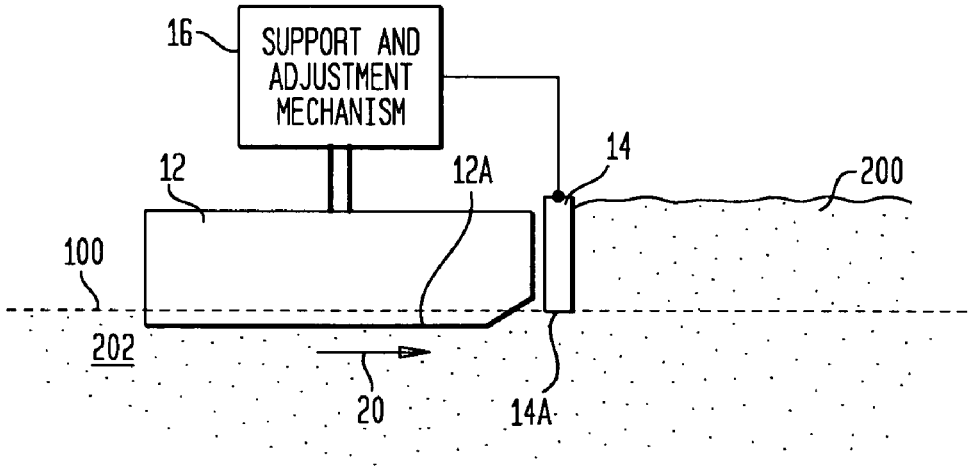
FIG. 2B is a side schematic view of the floating screed device of FIG. 1 operating below a target elevation.
Figure 2C:
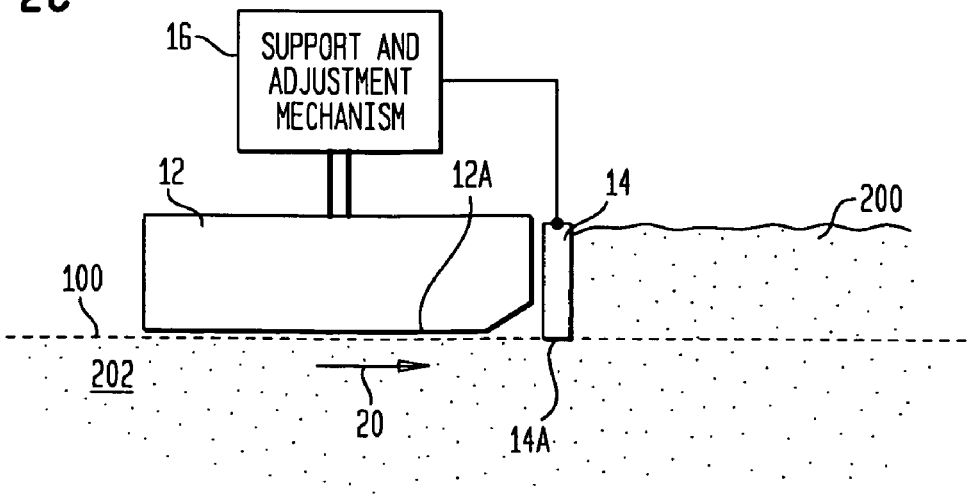
FIG. 2C is a side schematic view of the floating screed device of FIG. 1 operating above a target elevation.

In FIG. 2B, bottom 12A of float 12 is below target elevation 100. Accordingly, bar 14 is raised up to position bottom edge 14A at target elevation 100. As device 10 advances in direction 20, float 12 pitches up as it encounters an uphill slope in the concrete created by the raised position of bar 14. In a similar fashion for the situation defined by bottom 12A of float 12 being above target elevation 100 as illustrated in FIG. 2C, bar 14 is lowered to position bottom edge 14A at target elevation 100. As device 10 advances in direction 20, float 12 pitches down as it encounters a downhill slope in the concrete created by the lowered position of bar 14.

Figure 3:
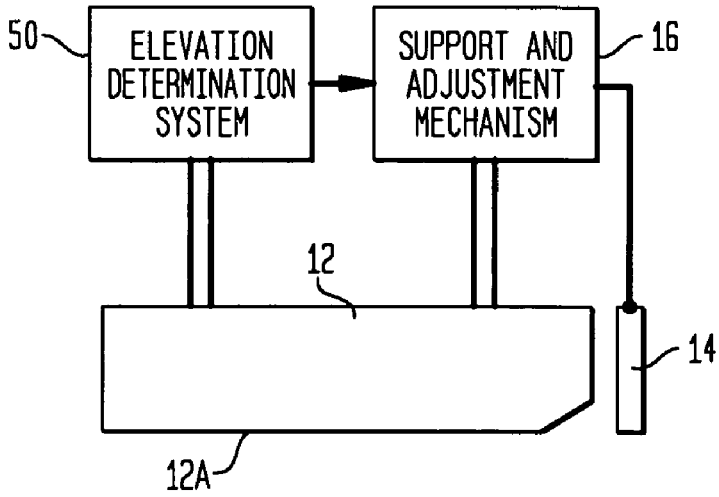
FIG. 3 is a side schematic view of the floating screed device of FIG. 1 further equipped with an elevation determination system.

As mentioned above, the raising or lowering of bar 14 can be automated. An example of such automation is illustrated in FIG. 3 where an elevation determination system 50 is mounted to float 12. For example, system 50 can be part of a laser level system, the use of which in concrete floor construction is well known and understood. In general, elevation determination system 50 determines the height of float 12 (e.g., bottom 12A of float 12) relative to a target height (i.e., target elevation 100). The output of system 50 is an amount of perpendicular movement of bar 14 (i.e., relative to float bottom 12A) required to achieve the target height as floating screed device 10 is moved in the direction of arrow 20. The output of system 50 is supplied to S/A mechanism 16 which, in turn, applies the requisite amount of up or down force to bar 14.

Figure 4:
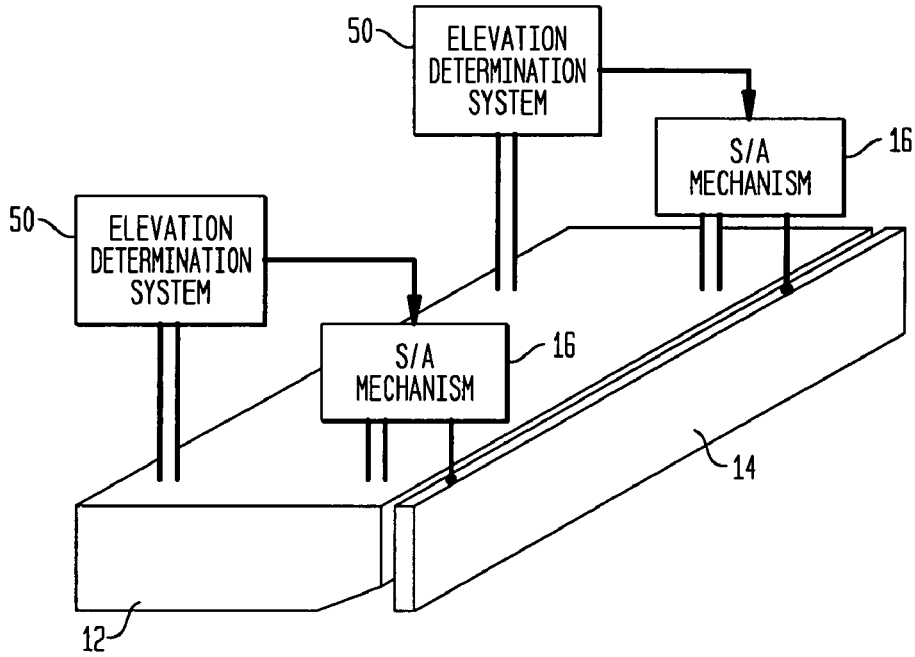
FIG. 4 is a part perspective, part schematic view of the floating screed device equipped with multiple and independently-operated systems for adjusting the height of the screed device's bar.

As the length of bar 14 increases, it may be necessary to use multiple, independently-operating elevation determination systems 50 and corresponding S/A mechanisms 16 (as illustrated in FIG. 4) to account for possible actual height differences measured by systems 50. Thus, the use of multiple S/A mechanisms 16 allows bar 14 to be tilted along the length thereof as differential loads are applied to bar 14 by the independently-operated S/A mechanisms 16. In this way, the corresponding regions of bar 14 can be adjusted to correct for local differences from the target height of the concrete. Note that small amounts of tilt may be necessary since the length of a typical bar 14 can be on the order of 15 feet or more.

Figure 5:
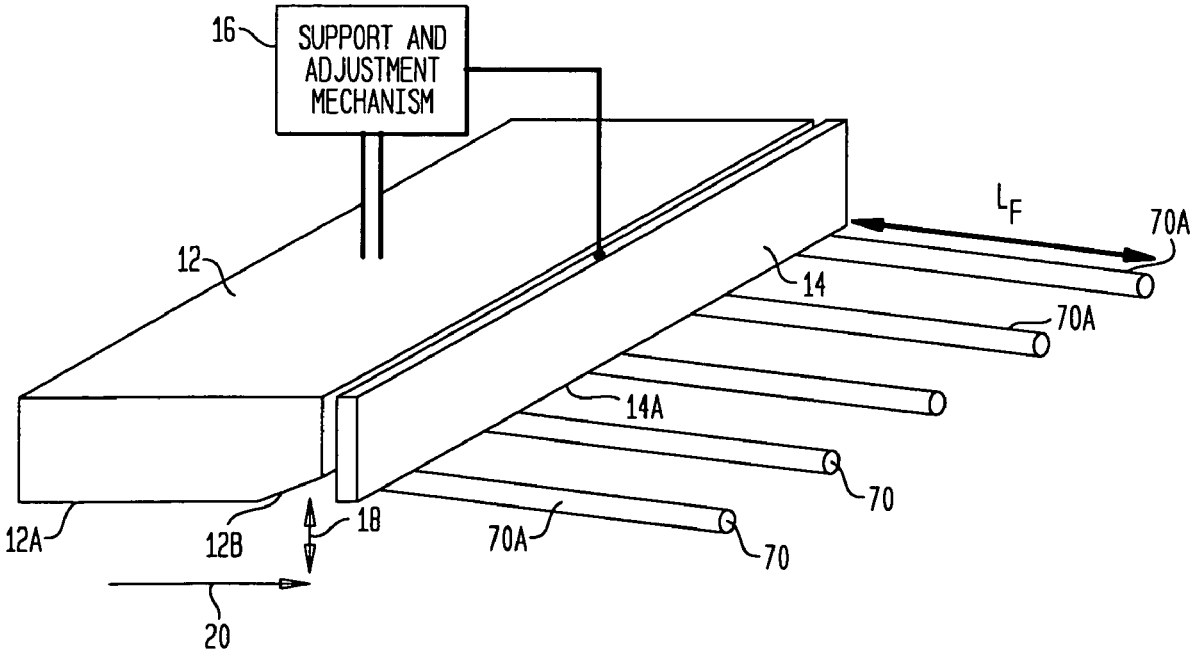
FIG. 5 is a perspective view of a floating screed device of FIG. 1 further equipped with a rake guide formed by rigid fingers extending from the device's bar.

Owing to the weight and density of unfinished concrete, it is necessary for the rake workers (i.e., those workers standing in the unfinished concrete forward of the screed operator) to prevent any substantial build up of unfinished concrete just ahead of the screed as this makes the screed operator's job extremely difficult. To remedy this situation, a novel type of rake guide can be added to bar 14 to provide the rake workers with a guide that would prevent concrete build up at the blade's leading edge. For example, FIG. 5 illustrates bar 14 with a plurality of rigid fingers 70 attached to bar 14 (e.g., along bottom edge 14A) that protrude forward therefrom. The exposed tops 70A of fingers 70 are aligned with bottom edge 14A such that tops 70A define a planar region at what will be the finish height of the concrete (not shown).

Spacing between adjacent ones of fingers 70 is such that a rake worker's blade (not shown) will rest on at least two of fingers 70 when the rake blade is placed thereon. In this way, a rake worker can pull excess concrete away from bottom edge 14A at the finish height of the concrete. Further, even if the rake worker's rake stroke lands in front of bottom edge 14A and on tops 70A, the rake stroke will still be completed at the finish grade of the concrete. Thus, during the raking and screeding process, the protruding length $L_F$ of fingers 70 defines a region forward of bar 14 that will be free of concrete build-up.

Length $L_F$ can be any reasonable length over which fingers 70 remain rigid. If the length of fingers 70 is such that it causes a change in the bar's balance, counter weights (not shown) can be used to re-balance the bar. The shape of fingers 70 is not a limitation of the present invention. For example, the cross-sectional shape of fingers 70 can be round (as shown) or any other shape without departing from the scope of the present invention. Regardless of their shape, any minor grooves formed by fingers 70 in the unfinished concrete are quickly "floated" to the finish concrete height as float 12 (tracking behind bar 14) moves thereover.

Fingers 70 could also be colored along the length thereof in one or more colors that are different from the color of the plastic concrete being finished. Fingers 70 could just be colored all along their length or just near their outboard ends. By coloring fingers 70 in this way, the rake worker is provided with both tactile feedback (i.e., as the rake contacts fingers 70) and visual feedback.

Thus, although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described. What is claimed as new and desired to be secured by Letters Patent of the United States is:

The invention claimed is:

1. A floating screed device comprising:

a first section defining a leading edge for cutting through plastic concrete;

a second section having a planar bottom for floating on the plastic concrete;

elevation determining means coupled to said second section for determining elevation of said second section relative to a desired finished elevation of the plastic concrete; and means coupled to said first section and said second section for supporting said first section relative to said second section and for moving said first section relative to said second section in a direction perpendicular to said planar bottom of said second section based on said elevation of said second section relative to the desired finished elevation as said floating screed device is moved through a volume of the plastic concrete that is unfinished with said leading edge defining an initial contact edge between said floating screed device and the volume of the plastic concrete that is unfinished.

2. A floating screed device as in claim 1 wherein said means is coupled to said first section at multiple locations along the length thereof, and wherein said means is independently controllable at each of said multiple locations.

3. A floating screed device as in claim 1 further comprising a plurality of rigid and spaced-apart fingers coupled to a bottom edge of said first section and extending therefrom with tops of said fingers defining a planar region aligned with said bottom edge.

4. A floating screed device comprising:

an elongated and rigid bar;

an elongated float having a planar bottom for floating on plastic concrete;

means coupled to said elongated float for determining elevation thereof relative to a desired finished elevation in the plastic concrete; and a support and adjustment mechanism coupled to said float, said bar and said means for determining elevation, for positioning said bar in a spaced apart relationship with respect to said float and for moving said bar perpendicularly with respect to said planar bottom of said float based on said elevation of said float relative to the desired finished elevation as said floating screed device is moved through a volume of the plastic concrete that is unfinished with said bar defining an initial contact edge between said floating screed device and the volume of the plastic concrete that is unfinished.

5. A floating screed device as in claim 4 wherein said support and adjustment mechanism is coupled to said bar at multiple locations along the length thereof, and wherein said support and adjustment mechanism is independently controllable at each of said multiple locations.

6. A floating screed device as in claim 4 further comprising a plurality of rigid and spaced-apart fingers coupled to a bottom edge of said bar and extending therefrom with tops of said fingers defining a planar region aligned with said bottom edge.

* * * * *